US011104176B2

(12) United States Patent
Peters et al.

(10) Patent No.: US 11,104,176 B2
(45) Date of Patent: Aug. 31, 2021

(54) BENDING SYSTEM, ENGRAVE SYSTEM AND VALUE DOCUMENT MANUFACTURING DEVICE

(71) Applicant: IAI industrial systems B.V., Veldhoven (NL)

(72) Inventors: Maikel Peters, Reusel (NL); Johannes Hendrikus Antonius Verheijen, Eindhoven (NL)

(73) Assignee: IAI industrial systems B.V., Veldhoven (NL)

( * ) Notice: Subject to any disclaimer, the term of this patent is extended or adjusted under 35 U.S.C. 154(b) by 0 days.

(21) Appl. No.: 16/891,958

(22) Filed: Jun. 3, 2020

(65) Prior Publication Data

US 2020/0391536 A1 Dec. 17, 2020

(30) Foreign Application Priority Data

Jun. 11, 2019 (EP) ..... 19179439

(51) Int. Cl.
*B42D 25/435* (2014.01)
*B65H 45/12* (2006.01)
(Continued)

(52) U.S. Cl.
CPC ..... *B42D 25/435* (2014.10); *B42D 9/04* (2013.01); *B65H 45/00* (2013.01); *B65H 45/12* (2013.01);
(Continued)

(58) Field of Classification Search
CPC . B42D 9/04; B42D 9/06; B42D 9/065; B42D 9/08; B42D 25/435; B42D 25/485; B65H 45/00
See application file for complete search history.

(56) References Cited

U.S. PATENT DOCUMENTS 5,493,943 A 2/1996 Horikawa
9,346,308 B2 * 5/2016 Lind ..... B42D 25/41
2014/0059903 A1 * 3/2014 Li ..... B42D 9/04 40/533

FOREIGN PATENT DOCUMENTS

DE 102013112872 5/2015
EP 0459438 A1 12/1991
(Continued)

OTHER PUBLICATIONS

"European Application Serial No. 19179439.5, Response filed Mar. 22, 2021 to Communication pursuant to Rule 69 EPC dated Dec. 21, 2020 and European Search Report dated Apr. 7, 2020", 12 pgs.
(Continued)

*Primary Examiner* — Daniel S Larkin
(74) *Attorney, Agent, or Firm* — Schwegman Lundberg & Woessner, P.A.

(57) ABSTRACT

A bending system for separating a page from a cover of a value document, wherein the page is connected to a spine of the cover, the spine separating the cover in first and second cover portions, wherein an angle γ is formed between the first and second cover portions. The bending system includes a bending unit connected to a motor, wherein the motor is configured to operate the bending unit such that the bending unit bends the value document to a first state, where γ is larger than 180°, and then back to a second state, where γ is at least 180° but less than γ in the first state, to separate the page from the cover. Also disclosed is an engraving system for engraving a front side and backside of a page of the value document and a document manufacturing device including the bending system and engraving system.

10 Claims, 11 Drawing Sheets

(51) Int. Cl.

| | |
|---|---|
| ***B65H 45/18*** | (2006.01) |
| ***B65H 45/00*** | (2006.01) |
| ***B42D 9/04*** | (2006.01) |
| *B42D 25/24* | (2014.01) |
| *B42D 25/485* | (2014.01) |

(52) U.S. Cl.
CPC ..... *B65H 45/18* (2013.01); *B42D 25/24* (2014.10); *B42D 25/485* (2014.10)

(56) References Cited

FOREIGN PATENT DOCUMENTS

| | | |
|---|---|---|
| GB | 2471590 A | 1/2011 |
| WO | WO-0154918 A1 | 8/2001 |

OTHER PUBLICATIONS

"European Application Serial No. 19179439.5, Extended European Search Report dated Apr. 7, 2020", 9 pgs.
"European Application Serial No. 19179439.5, Communication Pursuant to Article 94(3) EPC dated May 20, 2021", 3 pgs.
"European Application Serial No. 21154183.4, Extended European Search Report dated May 25, 2021", 7 pgs.

* cited by examiner

BENDING SYSTEM, ENGRAVE SYSTEM AND VALUE DOCUMENT MANUFACTURING DEVICE

CROSS-REFERENCE TO RELATED APPLICATIONS

The present application claims priority to European Patent Application No. 19179439.5, titled "Bending System, Engrave System and Value Document Manufacturing Device," filed Jun. 11, 2019, which is hereby incorporated herein by reference in its entirety.

FIELD

The disclosure relates to manufacturing of value documents, like passports and other value documents, and more specifically to a bending system, an engraving system and a value document manufacturing device.

BACKGROUND

Recently, there are high efforts on tampering value documents, like passports and other value documents. Therefore, there is a growing demand for safer value documents, i.e. value documents which are tamper-proof. However, it is challenging to manufacture such tamper-proof passports and other value documents. It is thus an object of the present invention to provide a bending system, an engraving system and a value document manufacturing device suitable for manufacturing such tamper-proof passports and other value documents.

SUMMARY

This object is accomplished by a bending system, an engraving unit and a value document manufacturing device according to the present disclosure.

More specifically, a bending system for separating a page from a cover of a value document is provided. The page is connected to a spine of the cover. The spine separates the cover in a first cover portion and a second cover portion. An angle $\gamma$ is formed between the first cover portion and the second cover portion. The bending system comprises a bending unit connected to a motor. The motor is configured to operate the bending unit such that the bending unit bends the value document to a first state where $\gamma$ is larger than 180° and then backwards to a second state where $\gamma$ is at least 180° to separate the page from the cover of the value document.

The value document may be a passport or any other value document. The page may be a first page, such as a data page, and a second page following the first page and being connected to the spine may be, for example, a visa page. The motor may be an electric motor. The bending unit may have a two-piece design, i.e. the bending unit may comprise a first and a second plate pivotably connected to each other. In example embodiments, in the first state, $\gamma$ is larger than 180° and smaller than 270°, and in further example embodiments, $\gamma$ is larger than 220° and smaller than 250°. In example embodiments, in the second state, $\gamma$ is 180°. The angle $\alpha$ is defined between a front side of the first page and a front side of the second page. The spine of the value document may be formed in the middle of the cover such that the two cover portions have substantially a same size or length. A backside of the first page and/or a backside of the second page may be in contact with an inside of the cover when the value document is in a closed state. The value document may also be referred to as a book or booklet.

The motor may be configured to move the bending unit away from the value document after the value document reaches the second state. The bending unit may be moved vertically upwards to separate from the value document.

The bending system may be configured to move a separating device between the (first) page and the cover after or when the value document reaches the second state, i.e. when the first page and the cover are separated from each other. The separating device may be a wedge or a plate. For moving and/or activation of the movement of the separating device, the bending system may comprise solenoids.

The bending system may comprise a separation sensor. The separation sensor may be configured to determine if the value document is in the second state. The separation sensor may be configured to output a signal to the separating device, more specifically to a controller provided for the separating device, such that moving and/or activation of the movement of the separating device is caused when the value document is in the second state, i.e. when the (first) page and the cover are separated from each other.

The bending system may comprise a lever pivotably connecting the bending unit to the motor. The lever may be provided for transmitting a force from the motor to the bending unit to operate the bending unit. The lever may be fixed to an output shaft of the motor and pivotably connected to the bending unit.

The bending system may comprise at least one position sensor, which in at least one example embodiment includes two position sensors, configured to sense, i.e. determine, a position of the motor and/or the bending unit. The at least one position sensor may be configured to output a signal to the separating device, more specifically to a controller provided for the separating device, such that moving and/or activation of the movement of the separating device is caused when the value document is in the second state, i.e. when the (first) page and the cover are separated from each other, determined based on a position of the motor and/or the bending unit.

The bending unit may comprise at least one ceramic element provided for contacting the (first) page (and/or the second page) during separation thereof from the cover. The ceramic element may be a ball or a wheel wherein at least a surface thereof comprises ceramic or is preferably made from ceramic. The at least one ceramic element may be rotatably supported at the bending unit. The ceramic element may be part of a ceramic ball strip. A ceramic ball strip may comprise a plurality of ceramic elements, e.g. three or four ceramic elements, arranged in a row. The least one ceramic element is provided for avoiding scratches in a surface layer of the pages of the value document during bending of the value document.

The bending system may further comprise a pivoting plate for positioning of the cover during separating the (first) page from the cover. The pivoting plate may be pivotably supported at a frame of the bending system. The bending system may further comprise a guidance plate for clamping the cover (and/or the second page) of the value document at least in the second state. The guidance plate may be activated by a solenoid. The activation of the guidance plate may be based on an output of the at least one position sensor and/or the separation sensor.

Furthermore, an engraving system comprising a support plate and an engraving unit is provided. The engraving unit is configured to engrave both a front side and a backside of at least one page of a value document. The value document may have the same configuration as the value document described above. The engraving unit comprises a page flip mechanism, a carrier and an engraver. The page flip mechanism is provided for turning the at least one page from the front side to the backside thereof and vice versa. The carrier is provided for supporting the value document. The engraver, which in an example embodiment is a laser engraver, is configured to engrave the at least one page of the value document. The page flip mechanism and the carrier are arranged to be moveable with respect to, i.e. relative to, the support plate. That is, both, the carrier and the page flip mechanism, can be moved relative to the support plate. The support plate may comprise rails or tracks for movement of the page flip mechanism and the carrier. The carrier is arranged to be moveable with respect to, i.e. relative to, the page flip mechanism. Therefore, it is possible, that a position of the engraver for engraving both the front side and the backside of the at least one page remains unchanged. Engraving may comprise providing a lenticular screen on the at least one page. A position of the support plate and a position of the engraver may be fixed in space. For movement of the flip mechanism and the carrier relative to each other and relative to the support plate, one or more motors may be provided. The engraving system may further comprise a camera for aligning data to be engraved on the at least one page.

The carrier may further comprise a shaft. The shaft may be a spindle. The carrier may be arranged to be moveable along the shaft with respect to, i.e. relative to, the page flip mechanism.

The engraving unit may comprise at least one separating device, which in at least one example embodiment includes two separating devices, for separating a cover and the at least one page of the value document. That is, the at least one separating device ensures separation of the at least one page of the value document from the rest of the value document during laser engraving thereof.

Furthermore, a value document manufacturing device comprising the above described bending system and the above described engraving system is provided. In the manufacturing device, the bending system may be provided before the engraving system with respect to manufacturing steps of the value document. The value document manufacturing device may further comprise an input stacker. The input stacker may be an automated input stacker. The input stacker may be configured to be openable by an operator such that the operator can open the value document at a predetermined position and place the opened value document in the stacker. The stacker can be configured to hold up to 30 value documents. The system may be equipped with an inkjet printer, e.g. a full colour inkjet engine, configured to print data on a first page. A camera may be provided at the laser engraver for reading a position of pre-printed headers to align the data. After printing, UV light may be provided by a UV-light emission unit for drying ink output by the printer. A value document identification unit may be provided configured to identify the value document by reading a barcode with a camera from an outside of the cover of the value document. Alternatively or additionally, the value document identification unit may be configured to identify the value document by reading information from a chip provided on or at the value document. The value document manufacturing device can be equipped with at least one encoding unit for contactless chip encoding. The encoding unit may use an open interface allowing a value document manufacturer to use his own encoding software. The encoding unit may be configured to check functionality of the chip before programming thereof. Value documents with defective chips may be returned or output unprocessed. The value document manufacturing device may further comprise at least one camera configured to check applied visual data and features and/or a chip reader configured to check electronic data to determine whether the information is applied correctly to the value document. Rejects may be sent to a reject bin.

BRIEF DESCRIPTION OF THE DRAWINGS

The drawings illustrate generally, but not by way of limitation, various embodiments discussed in the present disclosure.

DETAILED DESCRIPTION

Figure 1:
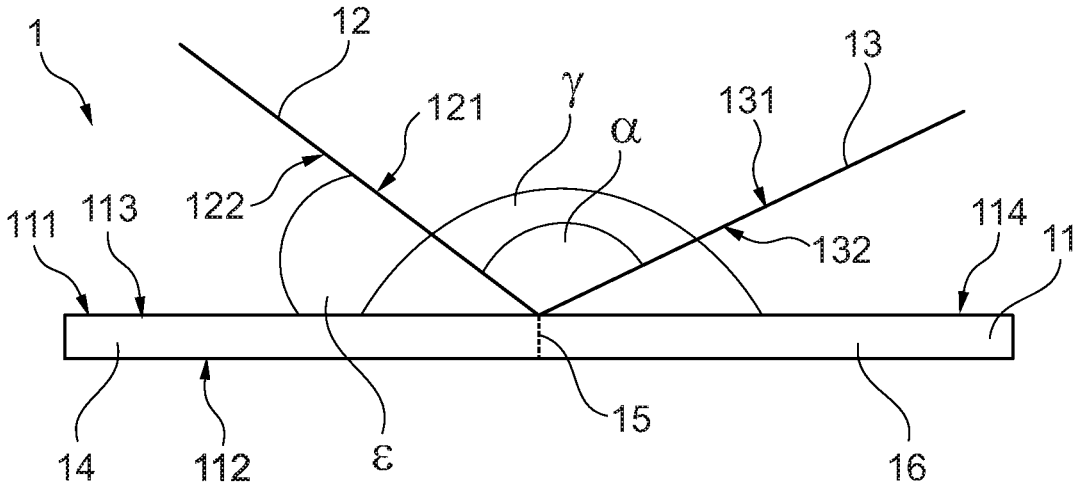
FIG. 1 depicts schematically a passport in an intermediate state.

In FIG. 1, a value document, in this embodiment a passport 1, is shown schematically in an intermediate state for explaining a setup thereof.

The passport 1 comprises a cover 11 and two pages 12, 13 connected to a spine 15 of the cover 11. The spine 15 is provided in the middle of the cover 11 and separates the cover 11 in two portions, i.e. a first portion 14 and a second portion 16. In the intermediate state as shown in FIG. 1, the cover 11 is open. That is, an angle γ formed between the first and the second portions 14, 16 of the cover 11 is 180°. The cover 11 comprises an inside 111 and an outside 112. The first page 12 comprises a frontside 121 and a backside 122. The second page 13 comprises a frontside 131 and a backside 132. In the intermediate state, an angle α between the frontside 121 of the first page 12 and frontside 131 of the second page 13 is between 0° and 180°, i.e. 0°<α<180°. Furthermore, an angle ε is formed between the first page 12 and the cover 11. More specifically, the angle ε is formed between the first page 12 and the first portion 14 of the cover 11.

In a closed state of the cover 11, the frontside 121 of the first page 12 and the frontside 131 of the second page 13 are in contact with each other, i.e. α, γ and ε are substantially 0°. In the closed state of the cover 11, the backside 122 of the first page 12 and the backside 132 of the second page 13 are in contact with the inside 111 of the cover 11. More specifically, in the closed state, the backside 122 of the first page 12 is in contact with a first portion 113 of the inside 111 of the cover 11 and the backside 132 of the second page 13 is in contact with a second portion 114 of the inside 111 of the cover 11. The first portion 113 of the inside 111 of the cover 11 corresponds to the first portion 14 of the cover 11. The second portion 114 of the inside 111 of the cover 11 corresponds to the second portion 16 of the cover 11. The spine 15 is formed in the middle of the cover 11 such that the resulting two cover portions 14, 16 have substantially a same size and/or length.

Figure 2:
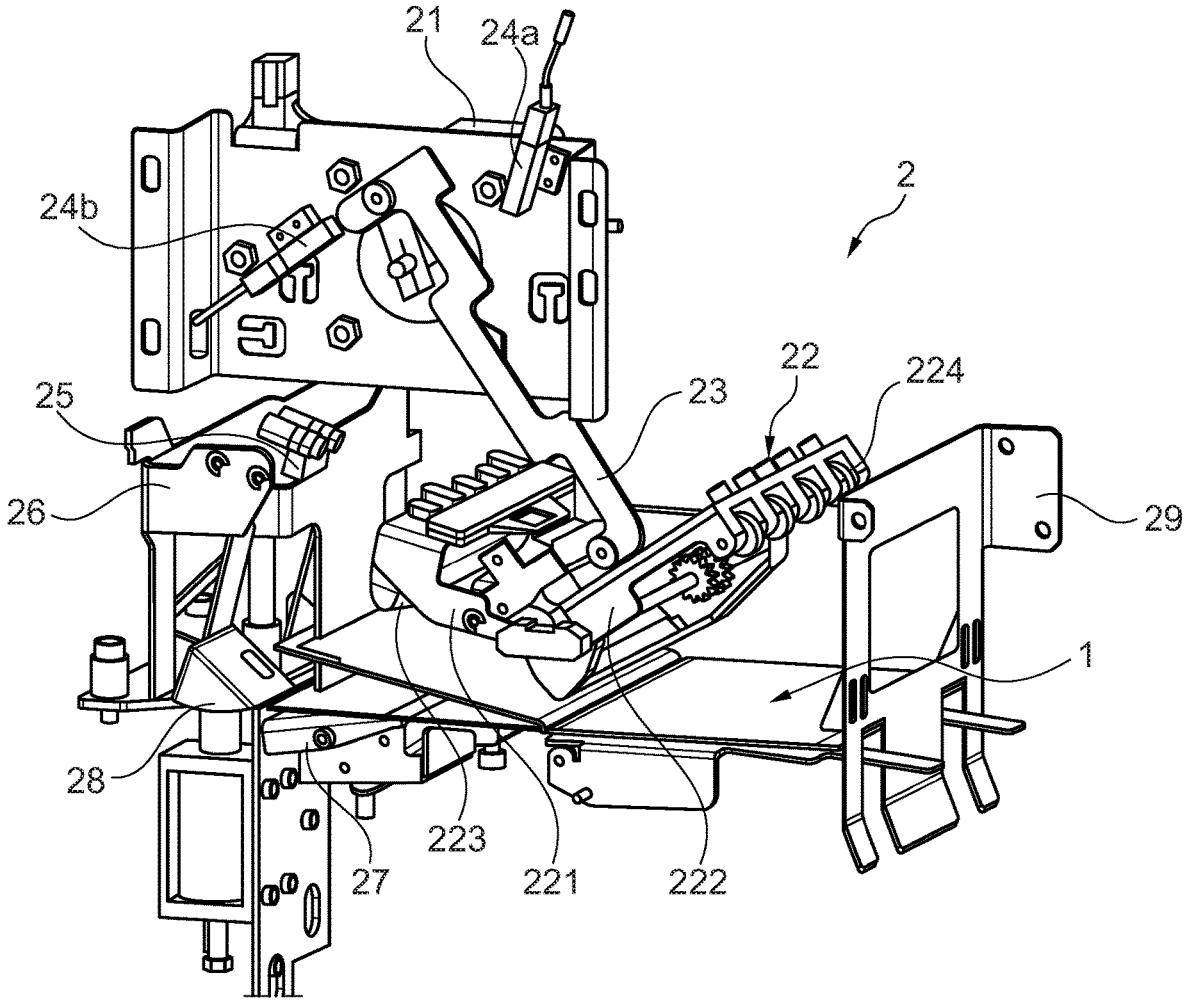
FIG. 2 depicts schematically a bending system according to one embodiment of the invention.

In FIG. 2, a bending system 2 is shown together with the passport 1 of FIG. 1 in a perspective view. The bending system 2 is configured to bend the passport 1 such that the first page 12 of the passport 1 separates from the first portion 14 of the cover 11, i.e. from the first portion 113 of the inside 111 of the cover 11 of the passport 1. The bending system 2 is further configured to insert a separating device 28 between the first portion 113 of the inside 111 of the cover 11 and the first page 12, after bending the passport 1.

More specifically, the bending system 2 comprises a motor 21, a bending unit 22, a lever 23, two position sensors 24*a*, 24*b*, a separation sensor 25, a frame 26, a pivoting plate 27, the separating device 28, and a guidance plate 29.

The motor 21 is configured to move the bending unit 22 via the lever 23. The lever 23 is pivotably connected to the bending unit 22 and is connected to an output shaft of the motor 21.

The bending unit 22 is configured to bend the passport 1 by being moved from the motor 21 via the lever 23 and comprises two plates 221, 222, wherein each plate 221, 222 comprises a ceramic ball strip 223, 224, respectively. The ceramic ball strips 223, 224 are provided for contacting the pages 12, 13 of the passport 1 during separation of the first page 12 from the cover 11. The ceramic ball strips 223, 224 are provided at one end of the first plate 221 and of the second plate 222, respectively. The ceramic ball strip 223, 244 includes at least two ceramic elements, e.g. a ball and/or a wheel comprising at least on its outer surface a ceramic layer, wherein the at least two ceramic elements are preferably arranged in a row.

The position sensors 24*a*, 24*b* are configured to sense a position of the motor 21 and/or the bending unit 22. In an example embodiment, the position sensors 24*a*, 24*b* are additionally or alternatively configured to sense a position of the lever 23. The position sensors 24*a*, 24*b* are configured to output information corresponding to the sensed position(s) to a control unit configured to control operation of the bending system 2 based on the received information from the position sensors 24*a*, 24*b*.

The separation sensor 25 is configured to detect if the separation is completed, i.e. if the separating device 28 is inserted between the first portion 113 of the inside 111 of the cover 11 and the first page 12 after separation thereof. The separation sensor 25 is also configured to output information corresponding to the separation to the above described control unit configured to control operation of the bending system 2 based on the received information from the separation sensor 25. In the present embodiment, the separating device 28 is a wedge. The frame 26 comprises solenoids for movement of the separation device 28. The pivoting plate 27 is provided for positioning of the cover 11 of the passport 1.

In the following, separation of the cover 11 and the first page 12 of the passport 1 shown in FIG. 1 by operation of the bending system 2 shown in FIG. 2 is explained in detail with respect to FIGS. 3*a* to 3*f*.

Figure 3A:
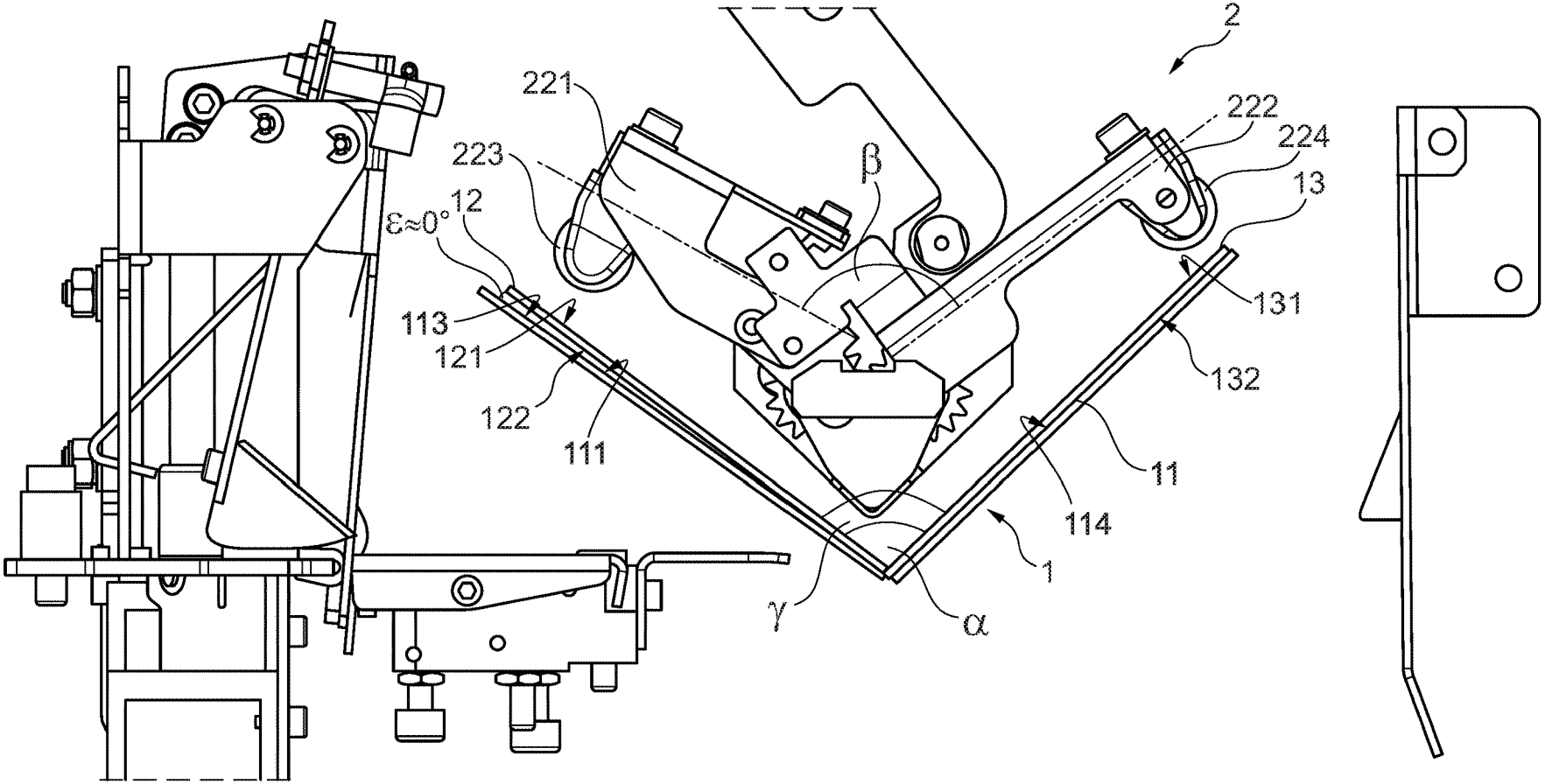
FIG. 3*a* depicts schematically a first step of turning a page of the passport shown in FIG. 1 with the bending system of FIG. 2.

As can be gathered from FIG. 3*a*, in operation of the bending system 2, the passport 1 is transported in a first step underneath the bending unit 22 in a V-shape. That is, the cover 11 of the passport 1 is opened to an angle larger than 0° and smaller than 180°. More specifically, the angles α and γ are substantially the same since the angle ε is substantially zero, and the angles α and γ are larger than 0° and smaller than 180°. The bending unit 22 is in an initial state located between the first and the second pages 12, 13 wherein the first and the second plates 221, 222 of the bending unit 22 are also in a V-shape. More specifically, the angle α between the frontside 121 of the first page 12 and the frontside 131 of the second page 13 is larger than 0° and smaller than 180°. An angle β between the first and the second plates 221, 222 of the bending unit 22 is substantially the same as the angle α such that the first plate 221 is arranged substantially near or in parallel to the first page 12 and the second plate 222 is arranged substantially near or in parallel to the second page 13. The backsides 122, 132 of the first and the second pages 12, 13 are in contact with the first portion 113 and the second portion 114 of the inside 111 of the cover 11, respectively.

Figure 3B:
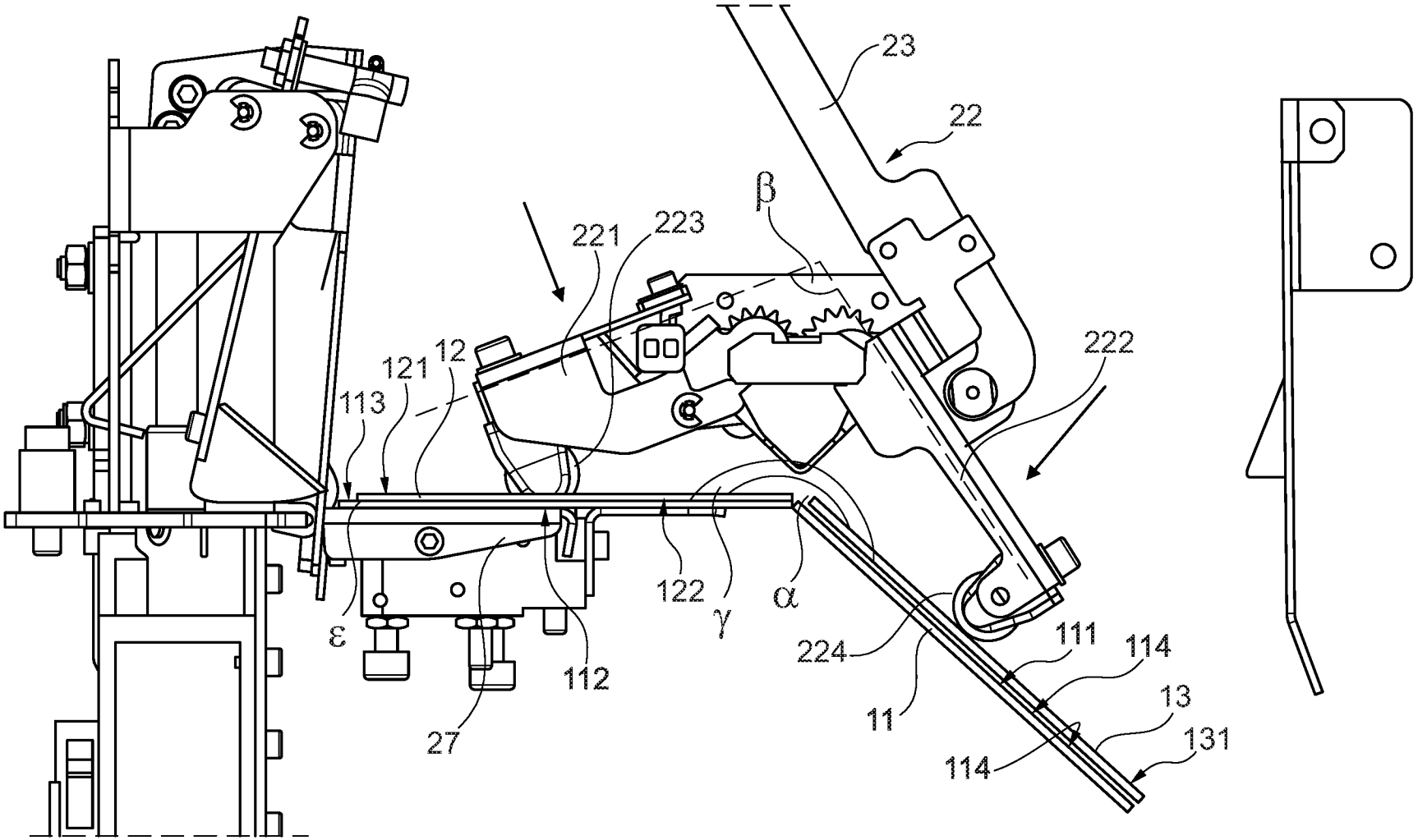
FIG. 3*b* depicts schematically a second step of turning the page of the passport shown in FIG. 1 with the bending system of FIG. 2.

As can be gathered from FIG. 3*b* and especially from the arrows shown therein, in a second step, when the passport 1 is underneath the bending unit 22, the bending unit 22 is activated by the motor 21 (see FIG. 2) via the lever 23 such that ceramic ball strips 223 and 224 come into contact with the front sides 121, 131 of the first and the second pages 12, 13 of the passport 1, respectively. Then, the passport 1 is bent to a state in which the angle α between the frontside 121 of the first page 12 and the frontside 131 of the second page 12, 13 is larger than 180°. More specifically, also here, the angles α and γ are substantially the same since the angle ε is substantially zero, and the angles α and γ are both larger than 180°. The backsides 122, 133 of the first and the second pages 12, 13 are still in contact with the first portion 113 and the second portion 114 of the inside 111 of the cover 11, respectively. More specifically, the first ceramic ball strip 223 is in contact with the frontside 121 of the first page 12 to press the backside 112 of the cover 11 onto the pivoting plate 27. The second ceramic ball strip 224 is in contact with the front side 131 of the second page 13 and pushes the second page 13 together with the second portion 114 of the cover 11 downwards such that the angles α and γ exceed 180°.

Figure 3C:
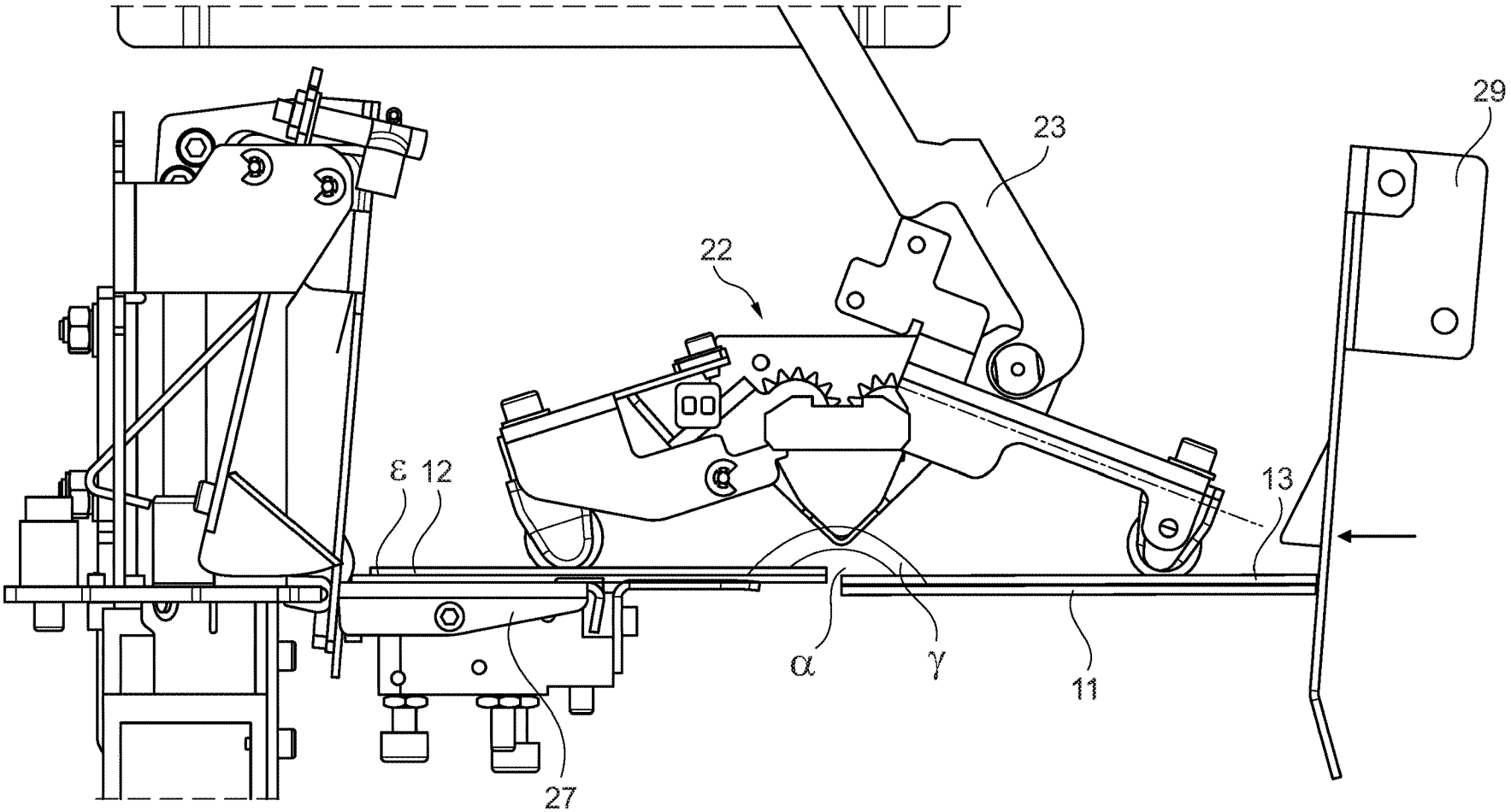
FIG. 3*c* depicts schematically a third step of turning the page of the passport shown in FIG. 1 with the bending system of FIG. 2.

Afterwards, as can be gathered from FIG. 3*c*, in a third step, the bending unit 22 is operated by the motor 21 (see FIG. 2) via the lever 23 such that it bends the cover 11 of the passport 1 back until the cover 11 is in the open state, i.e. the bending unit 22 stops when the cover 11 is completely flat (horizontal). In the open state, the angles α and γ are substantially 180°. The angle ε is still 0°. Then, as indicated by the arrow shown in FIG. 3*c*, the guidance plate 29 on a front of the bending system 2 is activated by a solenoid to clamp the cover 11, wherein the first page 12 and/or the second page 13 is/are not clamped because it/they is/are a bit shorter than the cover 11. The ceramic ball strips 223, 224 are still in contact with the front side 121, 131 of the first and second pages 12, 13, respectively.

Figure 3D:
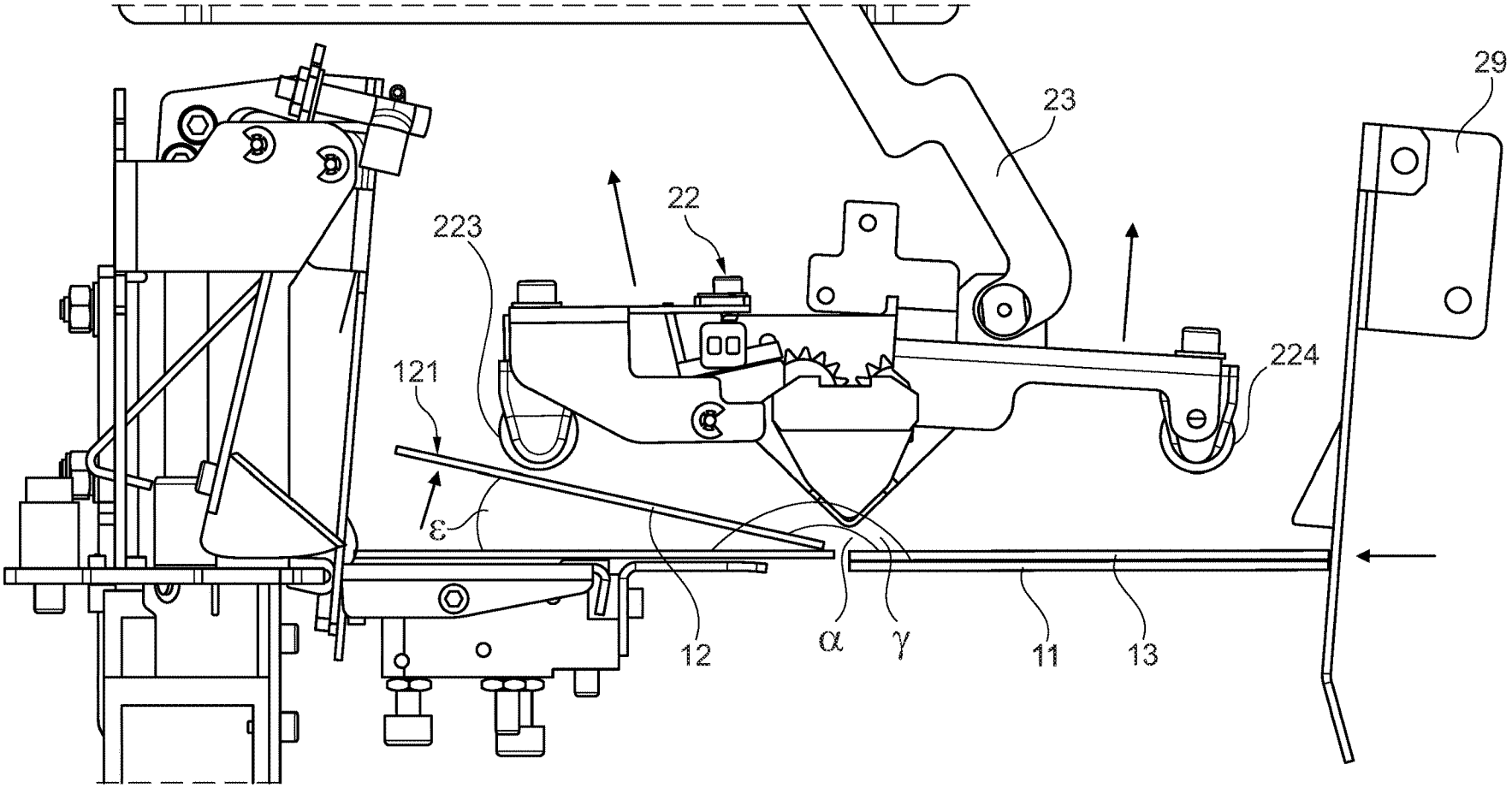
FIG. 3*d* depicts schematically a fourth step of turning the page of the passport shown in FIG. 1 with the bending system of FIG. 2.

Then, in a fourth step, the bending unit 22, e.g. the first and the second ceramic ball strips 223, 224 of the first and the second plates 222, 224, is operated by the motor 21 (see FIG. 2) via the lever 23 to move away from the cover 11, as can be gathered from FIG. 3*d* and especially from the arrows shown therein. Since the cover 11 is still clamped by the guidance plate 29 at least the first page 12 will now separate from the cover 11. More specifically, since the cover 11 is still clamped but the first ceramic ball strips 223 of the bending unit 22 are no longer in contact with the frontside 121 of the first page 12, the first page 12 can separate from the first portion 113 of the inside 111 of the cover 11. In the resulting separated state, the angle α is smaller than 180°. The angle ε is larger than 0°. The angle γ is still 180°. A sum of the angles α and ε is (substantially) the angle γ. Preferably, the guidance plate 29 is configured to clamp the second page 13 together with the cover 11.

Figure 3E:
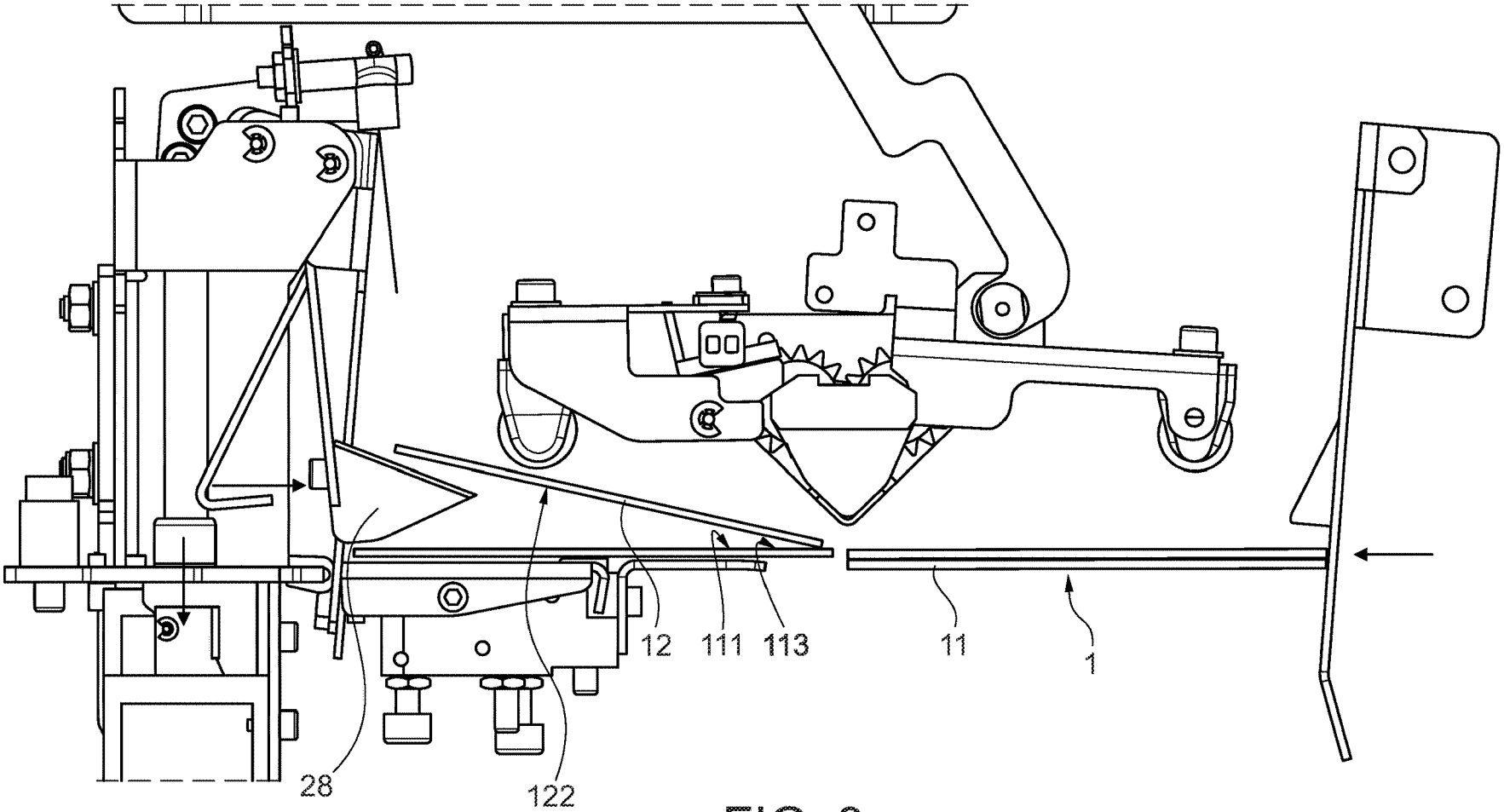
FIG. 3*e* depicts schematically a fifth step of turning the page of the passport shown in FIG. 1 with the bending system of FIG. 2.

Afterwards, as shown in FIG. 3*e*, during a fifth step, the separating device 28 is inserted between the backside 122 of the first page 12 and the first portion 113 of the inside 111 of the cover 11 to secure a separated position between the first page 12 and the cover 11. The guidance plate 29 still clamps the cover 11, and in some example embodiments also the second page 13. Here, the separating device 28 is a wedge having an angle smaller than the angle E to be insertable between the cover 11 and the first page 12.

Figure 3F:
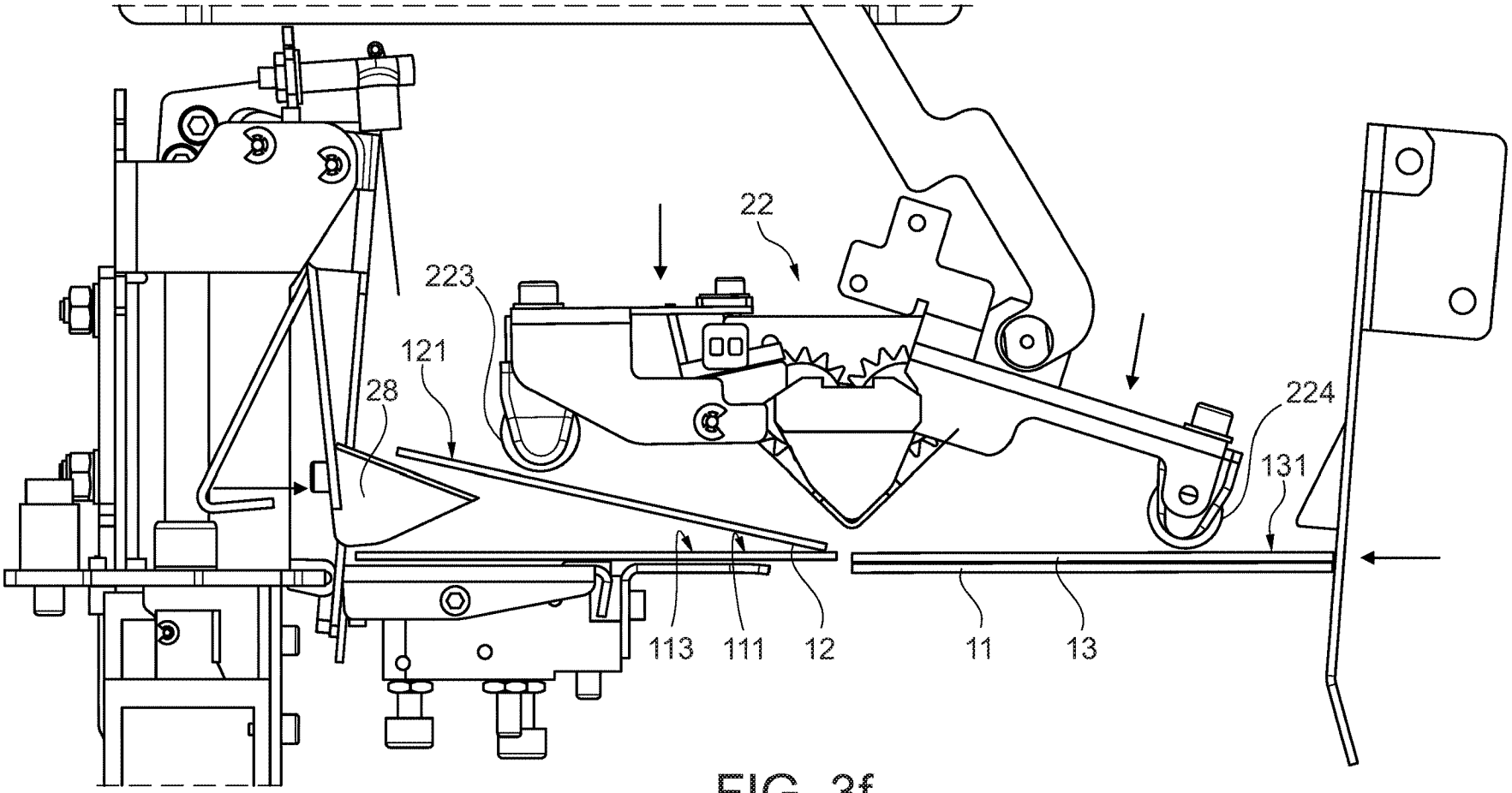
FIG. 3*f* depicts schematically a sixth step of turning the page of the passport shown in FIG. 1 with the bending system of FIG. 2.

Afterwards, as shown in FIG. 3*f* and especially by the arrows shown therein, when the separating device 28 is inserted between the backside 122 of the first page 12 and the first portion 113 of the inside 111 of the cover 11, the bending unit 22 moves down during a sixth step. Therefore, the first and the second ceramic ball strips 223, 224 come again in contact with the frontsides 121, 131 of the first and the second pages 12, 13, respectively.

The passport 1 is now ready for transport towards a laser engraving unit 4.

Figure 4B:
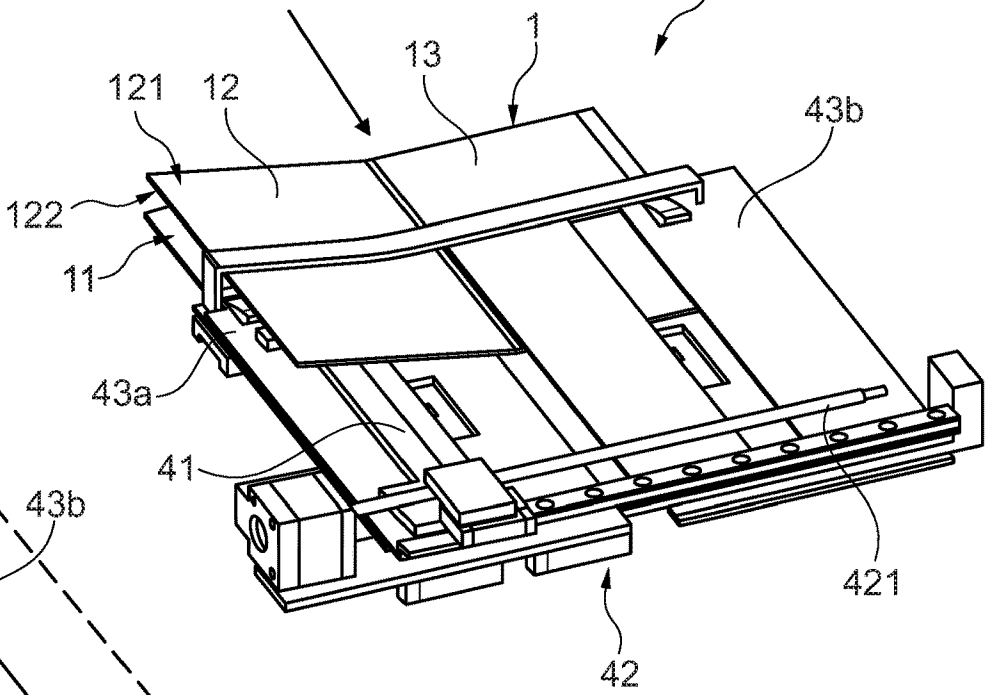
FIG. 4*b* depicts schematically the laser engraving unit of FIG. 4*a* and the passport of FIG. 1 arriving from the bending system of FIG. 2.
Figure 4A:
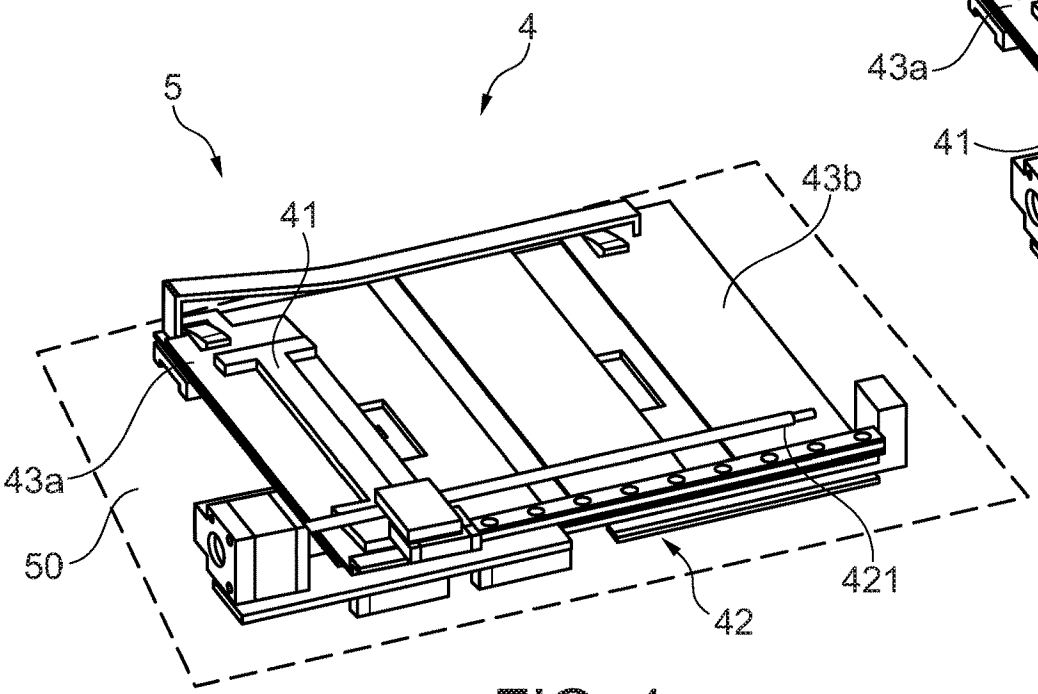
FIG. 4*a* depicts schematically a laser engraving unit according to one embodiment.

The laser engraving unit 4 will now be explained in detail with reference to FIGS. 4*a* and 4*b*. FIG. 4*a* depicts schematically a laser engraving system 5 comprising a support plate 50 and the laser engraving unit 4. Also, FIG. 4*b* depicts schematically the laser engraving unit 4 but also the passport 1 arriving from the bending system 2.

Figure 5B:
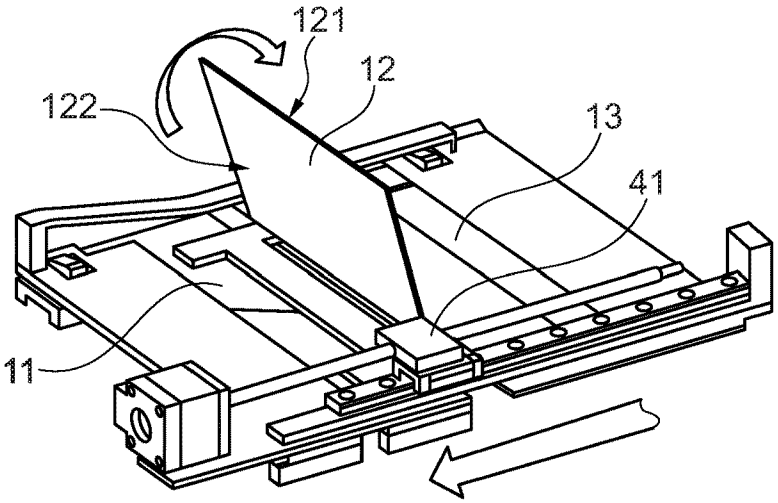
FIG. 5*b* depicts schematically a second step of laser engraving with the laser engraving unit of FIG. 4*a*.
Figure 5D:
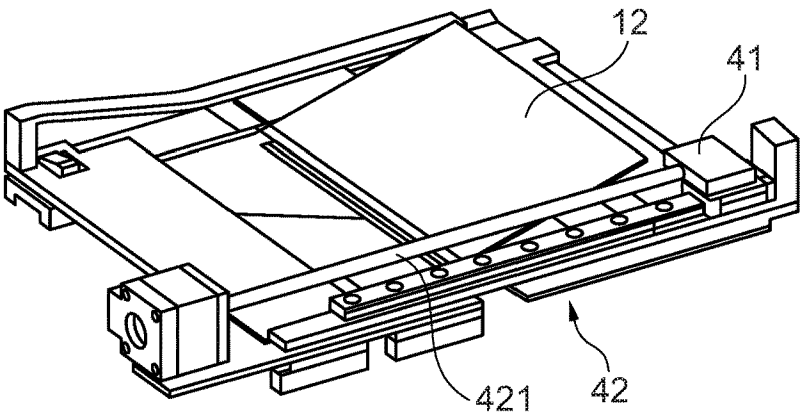
FIG. 5*d* depicts schematically a first part of a fourth step of laser engraving with the laser engraving unit of FIG. 4*a*.
Figure 5A:
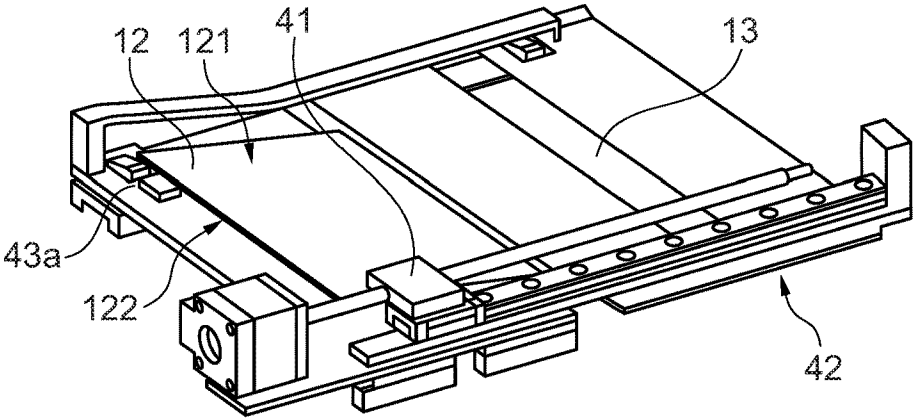
FIG. 5*a* depicts schematically a first step of laser engraving with the laser engraving unit of FIG. 4*a*.
Figure 5C:
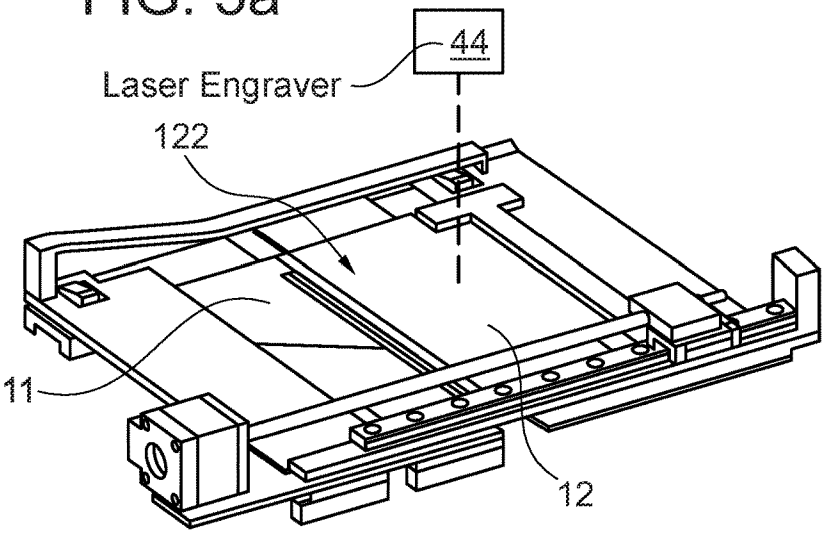
FIG. 5*c* depicts schematically a third step of laser engraving with the laser engraving unit of FIG. 4*a*.
Figures 5E, 5F, 5G:
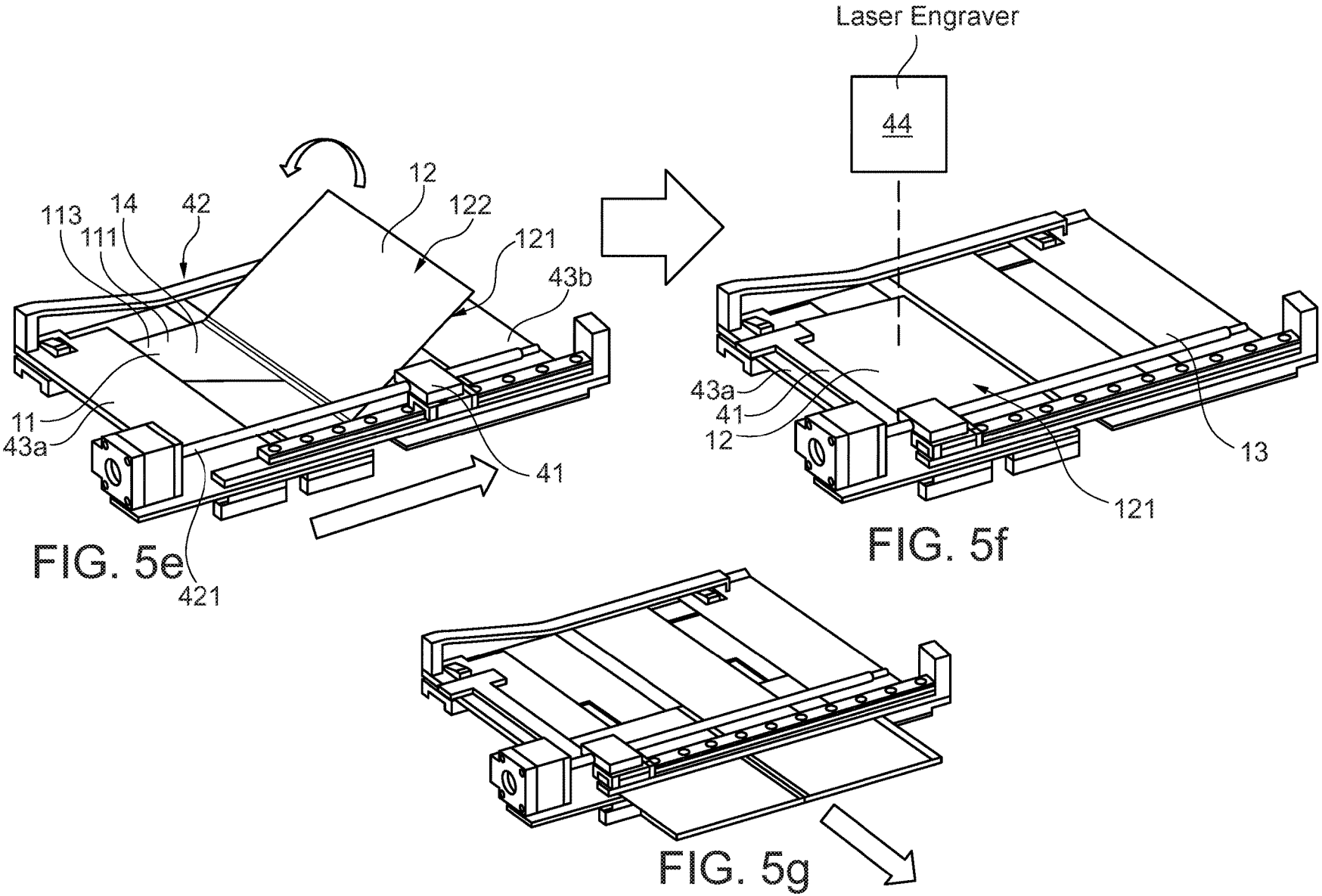
FIG. 5*e* depicts schematically a second part of the fourth step of laser engraving with the laser engraving unit of FIG. 4*a*.
FIG. 5*f* depicts schematically a fifth step of laser engraving with the laser engraving unit of FIG. 4*a*.
FIG. 5*g* depicts schematically a sixth step of laser engraving with the laser engraving unit of FIG. 4*a*.

The laser engraving unit 4 comprises a page flip mechanism 41, a carrier 42, and two separating devices 43*a* and 43*b*, as well as a laser engraver 44 (see FIGS. 5*c* and 5*f*). The page flip mechanism 41, the carrier 42, and the two separating devices 43*a* and 43*b* hold the passport 1 during operation of the laser engraving unit 4 and therefore form a passport holding device 41, 42, 43*a*, 43*b*. The laser engraver 44 is configured to (laser) engrave at least one page 12, 13 of the passport 1. The carrier 42 comprises a shaft 421. The carrier 42 is moveable along the shaft 421 relative to the page flip mechanism 41 during operation of the engraving unit 4. That is, during operation of the engraving unit 4, a position of the carrier 42 relative to the flip mechanism 41 changes.

Furthermore, the carrier 42 is supported on the support plate 50 such that it is moveable with respect to, i.e. relative to, the support plate 50. A position of the support plate 50 and of the laser engraver 44 is fixed in space. Thus, during operation of the engraving unit 4, the page flip mechanism 41, the carrier 42, and the two separating devices 43*a* and 43*b* are moved together with the passport 1 relative to a position of the laser engraver 44 and the support plate 50 such that the front 121 and the backside 122 of the first page 12 of the passport 1 can be laser engraved without changing the position of the laser engraver 44.

Thus, a position of the laser engraver 44 remains the same wherein the rest 41, 42, 43 of the engraving unit 4 is moved on the support plate 50 during laser engraving of the frontside 121 and the backside 122 of the first page 12 of the passport 1. The first separating device 43*a* is provided for being inserted between the first page 12 and the cover 11 of the passport 1, and the second separating device 43*b* is provided for being inserted between the first page 12 and the second page 13 of the passport 1 during operation of the engraving unit 4.

The operation of the laser engraving unit 4 will now be explained in detail, inter alia, with reference to FIGS. 5*a*-5*g*.

In a first step, shown in FIG. 5*a*, the passport 1 is arrived from the bending system 2 at the engraving unit 4, wherein the first page 12 is separated from the cover 11. When the passport 1 is arrived at the carrier 42 of the engraving unit 4, the flip mechanism 41 and the first separating device 43*a* are provided between the first page 12 and the cover 11 of the passport 1 and the second separating device 43*b* is provided above the second page 13 of the passport 1.

In a second step, shown in FIG. 5*b*, a tilting operation is carried out. During the tilting operation, the page flip mechanism 41 is moved relative to the carrier 42 via the shaft 421 such that the first page 12 is turned from its front page 121 facing the laser engraver 44 in an initial state to its backside 122. At the same time the page flip mechanism 41, the carrier 42, and the two separating devices 43*a* and 43*b* are moved (together with the passport 1) relative to the laser engraver 44 such that, after the first page 12 is turned, the backside 122 of the first page 12 faces the laser engraver 44. That is, before turning the first page 12, the frontside 121 thereof faces the laser engraver 44, i.e. is positioned substantially perpendicular below the laser engraver 44. After turning the first page 12, the backside 122 thereof faces the laser engraver 44, i.e. is positioned substantially perpendicular below the laser engraver 44. Therefore, the position of the laser engraver 44 remains unchanged.

Then, as shown in FIG. 5*c*, the laser engraver 44 engraves the backside 122 of the first page 12 in a third step. During laser engraving in the third step, the flip mechanism 41 pushes the backside 122 of the first page 12 towards the second separating device 43*b* being arranged between the frontside 121 of the first page 12 and the cover 11. Therefore, the position of the first page 12 with respect to the laser engraver 44 remains unchanged during laser engraving thereof.

Afterwards, a tilting back operation is carried out as shown throughout FIGS. 5*d* and 5*e* in a fourth step. As can be gathered from FIG. 5*e*, the first portion 14, i.e. the first portion 113 of the inside 111 of the cover 11, is in contact with the first separating device 43*a*. During the tilting back operation, the page flip mechanism 41 is moved in a reverse direction relative to the carrier 42 via the shaft 421 such that the first page 12 is turned from its back page 122 facing the laser engraver 44 during laser engraving in the third step to its frontside 121. At the same time, the flip mechanism 41, the carrier 42, and the two separating devices 43*a* and 43*b* are moved (together with the passport 1) relative to the laser engraver 44 such that, after the first page 12 is turned, the frontside 121 of the first page 12 faces the laser engraver 44. That is, before carrying out the tilting back operation of the first page 12, the backside 122 thereof faces the laser engraver 44, i.e. is positioned substantially perpendicular below the laser engraver 44. After turning the first page 12 back, the frontside 121 thereof faces the laser engraver 44, i.e. is positioned substantially perpendicular below the laser engraver 44. Therefore, also here, the position of the laser engraver 44 remains unchanged.

Then, as shown in FIG. 5*f*, the laser engraver 44 engraves the frontside 121 of the first page 12 in a fifth step. During laser engraving in the fifth step, the page flip mechanism 41 pushes the first page 12 towards the first separating device 43*a* being arranged between the backside 122 of the first page 12 and the cover 11. Therefore, also here, the position of the first page 12 with respect to the laser engraver 44 remains unchanged during laser engraving thereof.

Afterwards, as shown in FIG. 5*g*, the passport 1 is output from the engraving unit 4 in a sixth step.

REFERENCE SIGNS LIST

1 passport
11 cover
111 inside of cover
112 outside of cover
113 first portion of inside of cover
114 second portion of inside of cover
12 first page
121 frontside of first page
122 backside of first page
13 second page
131 frontside of second page
132 backside of second page
14 first portion of cover
15 spine
16 second portion of cover
2 bending system
21 motor
22 bending unit
221 first plate of bending unit
222 second plate of bending unit
223 first ceramic ball strip
224 second ceramic ball strip
23 lever
24*a*, 24*b* position sensor
25 separation sensor
26 frame
27 pivoting plate
28 separating device
29 guidance plate
4 laser engraving unit
41 page flip mechanism
42 carrier
421 shaft
43*a*, 43*b* separating device
α angle between first and second pages
β angle between first and second plate of bending unit
γ angle between first and second portion of cover
ε angle between first portion of cover and first page

The invention claimed is:

1. A bending system for separating a page from a cover of a value document, wherein the page is connected to a spine of the cover, the spine separating the cover in a first cover portion and a second cover portion, wherein an angle γ is formed between the first cover portion and the second cover portion, the bending system comprising:

a bending unit connected to a motor;

wherein the motor is configured to operate the bending unit such that the bending unit bends the value document to a first state where γ is larger than 180° and then back to a second state where γ is at least 180° but less than yin the first state to separate the page from the cover.

2. The bending system according to claim 1, wherein the motor is further configured to move the bending unit away from the value document when the value document reaches the second state.

3. The bending system according to claim 2, further comprising at least one position sensor configured to sense a position of at least one of the motor or the bending unit.

4. The bending system according to claim 1, wherein the bending system is further configured to move a separating device between the page and the cover when the value document is in the second state.

5. The bending system according to claim 4, wherein the separating device is a wedge.

6. The bending system according to claim 4, further comprising a separation sensor configured to determine if the value document is in the second state.

7. The bending system according to claim 4, wherein the bending system further comprises a lever pivotably connecting the bending unit to the motor.

8. The bending system according to claim 1, wherein the bending unit comprises at least one ceramic element provided for contacting the page.

9. The bending system according to claim 1, further comprising a pivoting plate for positioning of the cover during separating the page from the cover.

10. The bending system according to claim 1, further comprising a guidance plate for clamping the cover at least in the second state.

* * * * *